US012630911B2

(12) United States Patent
Sakai et al.

(10) Patent No.: US 12,630,911 B2
(45) Date of Patent: May 19, 2026

(54) DEGRADABLE MAGNESIUM ALLOY

(71) Applicant: KURIMOTO, LTD., Osaka (JP)

(72) Inventors: Takahiro Sakai, Osaka (JP); Akihiko Koshi, Osaka (JP); Masaaki Yamamoto, Osaka (JP); Jinsun Liao, Osaka (JP)

(73) Assignee: KURIMOTO, LTD., Osaka (JP)

( * ) Notice: Subject to any disclaimer, the term of this patent is extended or adjusted under 35 U.S.C. 154(b) by 923 days.

(21) Appl. No.: 17/769,126

(22) PCT Filed: Oct. 16, 2020

(86) PCT No.: PCT/JP2020/039111
§ 371 (c)(1),
(2) Date: Apr. 14, 2022

(87) PCT Pub. No.: WO2021/075552
PCT Pub. Date: Apr. 22, 2021

(65) Prior Publication Data

US 2024/0110269 A1 Apr. 4, 2024

(30) Foreign Application Priority Data

Oct. 18, 2019 (WO) ..... PCT/JP2019/041166

(51) Int. Cl.
*C22F 1/06* (2006.01)
*C22C 23/00* (2006.01)
*C22C 23/02* (2006.01)

(52) U.S. Cl.
CPC ..... *C22F 1/06* (2013.01); *C22C 23/00* (2013.01); *C22C 23/02* (2013.01)

(58) Field of Classification Search
None
See application file for complete search history.

(56) References Cited

U.S. PATENT DOCUMENTS

2008/0175744 A1 7/2008 Motegi et al.
2016/0201435 A1 7/2016 Fripp et al.
2019/0085432 A1 3/2019 Iwamoto et al.

FOREIGN PATENT DOCUMENTS

CN 104498792 4/2015
CN 103397235 8/2015
(Continued)

OTHER PUBLICATIONS

English language machine translation of JP-2005054233-A. Generated Nov. 12, 2024 (Year: 2024).*
(Continued)

*Primary Examiner* — Sally A Merkling
(74) *Attorney, Agent, or Firm* — Wenderoth, Lind & Ponack, L.L.P.

(57) ABSTRACT

A degradable structural member made of a magnesium alloy has a sufficient strength and is degradable at a proper timing in an aqueous environment. The magnesium alloy contains not less than 7.0% by mass and not more than 13.0% by mass of Al, not less than 4.5% by mass and not more than 13.0% by mass of Cu, and greater than 0% by mass and less than 0.10% by mass of Mn, with the balance being Mg and unavoidable impurities. The Al, Cu, and Mg are formed as finely dispersed intermetallic compounds throughout the magnesium alloy.

7 Claims, 13 Drawing Sheets

(56) References Cited

FOREIGN PATENT DOCUMENTS

| | | | |
|---|---|---|---|
| CN | 107523732 | | 12/2017 |
| CN | 107587019 | | 1/2018 |
| JP | 2-232332 | | 9/1990 |
| JP | 2005-54233 | | 3/2005 |
| JP | 2005054233 | A * | 3/2005 |
| JP | 2007-284743 | | 11/2007 |
| JP | 2008/072435 | | 6/2008 |
| JP | 2 088 217 | | 8/2009 |
| JP | 2017/168696 | | 10/2017 |

OTHER PUBLICATIONS

Murray et al. "Preparation and Characterization of Pure Metals." ASM Handbook, vol. 2: Properties and Selection: Nonferrous Alloys and Special-Purpose Materials. pp. 1093-1097. 1990. (Year: 1990).*

International Search Report issued Dec. 8, 2020 in corresponding International (PCT) Patent Application No. PCT/JP2020/039111.

English translation of International Preliminary Report on Patentability issued Apr. 19, 2022 in corresponding International (PCT) Patent Application No. PCT/JP2020/039111.

S. Takahashi et al., "Degradation Study on Materials for Dissolvable Frac Plugs", Unconventional Resources Technology Conference, 2018, pp. 1-9.

* cited by examiner

DEGRADABLE MAGNESIUM ALLOY

TECHNICAL FIELD

The present invention relates to a degradable magnesium alloy whose corrosion rate is adjustable to an arbitrary value.

BACKGROUND ART

In mining shale oil or shale gas, hydraulic fracturing (known as "fracking") is used. In this technique, after digging a well to a rock formation containing oil or gas, and fracturing the rocks under water pressure, oil or gas is released and recovered. The fracturing and recovery are performed multiple times in the well. Therefore, in order to increase the productivity of fracking, it is necessary to quickly remove a fracking member used in the previous fracking, thereby shortening the time to the next fracking.

Methods for quickly removing the fracking member include drilling through the fracking member, and corroding and dissolving the fracking member. The latter method is higher in productivity, but requires that the fracking member be made of a material which (i) retain sufficiently usable mechanical properties while the fracking member needs to perform its expected function, and (ii) quickly corrode thereafter.

As a material for such a fracking member, a polymeric material or a magnesium alloy having high degradability is used. Especially if high tensile strength is required, a magnesium alloy is suitably used. The higher the corrosion rate of the material per se, the higher the productivity of mining, naturally. Also, by improving the mechanical strength of the material, too, because a thin-walled member can be used as the fracking member, it is possible to shorten the time required for its degradation, and thus to improve the productivity of mining.

Such a degradable magnesium alloy is sometimes used together with a degradable polymer material. In this case, degradability and strength matching the degradable polymer material may be required.

Regarding specific degradability, non-patent document "Degradation Study on Materials for Dissolvable FracPlugs", S. Takahashi et al., Unconventional Resources Technology Conference (URTeC), 2901283, DOI 10.15530/urtec 2018 2901283, for example, discloses that the corrosion rates of degradable frac plugs are ordinarily 1000 to 1500 mg/cm$^2$/day in a 2% KCl solution.

WO2017168696A1 discloses a degradable Mg alloy containing not less than 3.9% by mass and not more than 14.0% by mass of Al; not less than 0.1% by mass and not more than 0.6% by mass of Mn; and not less than 0.01% by mass and not more than 10.0% by mass of one or both of Ni and Cu, with the balance being Mg and unavoidable impurities.

Japanese Unexamined Patent Application Publication No. H02-232332 discloses a highly corrosive magnesium alloy for extruded members which contains 0.02 to 5% by weight of any one or two or more of Ni, Fe and Cu (if two or more of these elements are contained, the total amount is 0.02 to 5% by weight); 0.5 to 3.5% by weight of Al; and 0.2 to 1.5% by weight of Zn, with the balance being Mg and unavoidable impurities.

CN104498792A discloses a corrosive magnesium alloy containing 1 to 6% by mass of Al; 1 to 6% by mass of Zn; 1 to 3% by mass of Fe; 5 to 15% by mass of Cu; 0.1 to 1% by mass of Ag; and 0.1 to 1.2% by mass of Ni.

CN107523732A discloses a degradable magnesium alloy containing 3.0 to 12% by mass of Al; 0.5 to 5% by mass of Zn; 0.5 to 3% by mass of Cu; and 0.1 to 1.0% by mass of Na.

CN107587019A discloses a degradable magnesium alloy which contains 3 to 15% by mass of Al; 0.5 to 5% by mass of Zn; 0 to 5% by mass of Cu; and 0 to 5% by mass of Ni, and in which, if one of the Cu and Ni contents is zero, the other is more than zero.

As shown in these documents, a corrosive or degradable magnesium alloy is often designed, by adding a metallic element more positive in electric potential than Mg, such as Cu or Ni, to form, in the Mg matrix, a metallic phase or a chemical compound phase containing intermetallic compounds of which the metallic phase or the chemical compound phase is more positive than Mg, thereby increasing the corrosion rate due to microcell corrosion between the intermetallic compounds and Mg. While the corrosion rate increases by increasing the amount of a metallic element more positive in electric potential than Mg, such as Cu or Ni, there is no prior art document that discloses the influence of the distribution of the intermetallic compounds produced at this time, on the corrosion rate.

In view of the above, it is an object of the present invention to obtain a magnesium alloy in which, by controlling the amount, size, distribution, etc. of intermetallic compounds produced, the corrosion rate and tensile strength are individually adjustable, and the corrosion rate is appropriately adjustable according to the circumstances of the mining site, thereby improving the productivity of mining.

SUMMARY OF THE INVENTION

In order to achieve the above object, the present invention provides a magnesium alloy comprising not less than 7.0% by mass and not more than 13.0% by mass of Al; not less than 4.5% by mass and not more than 13.0% by mass of Cu; not less than 0% by mass and less than 0.10% by mass of Mn; and a balance, the balancing being Mg and any unavoidable impurities, wherein the magnesium alloy includes finely dispersed intermetallic compounds.

For a degradable structural member composed of this magnesium alloy, it is possible to individually adjust its corrosion rate and tensile strength.

The above respective components are specifically described below. The addition of Al mainly increases the tensile strength. The addition of Cu produces Cu—Al—Mg-based intermetallic compounds having a positive electric potential. By the difference in electric potential between α-Mg and the Cu—Al—Mg-based intermetallic compounds, shrinkage of α-Mg progresses due to microcell corrosion, which mainly increases degradability. Magnesium alloys have a problem in that, if the Cu content is high, many or coarse Cu—Al—Mg-based intermetallic compounds are produced, thereby reducing the tensile strength. However, by controlling the amount and distribution of Cu—Al—Mg-based intermetallic compounds to reduce the sizes and improve the dispersibility, it is possible to increase the corrosion rate without decreasing the tensile strength.

The above intermetallic compounds can be made fine and dispersed, for example, by applying a large strain to a cast member after casting. Methods for applying a large strain include, e.g., drawing, extrusion, rolling, pressing and ECAP (Equal Channel Angular pressing). By applying strain, the intermetallic compounds are made fine and reduced in size, and the fine intermetallic compounds are dispersed such that the number of large lumps decreases, thus changing the distribution and improving the dispersibility.

In other words, the corrosion rate and tensile strength of the magnesium alloy according to the present invention are adjustable to estimated suitable values by adjusting the contents of Al and Cu, and the distribution and sizes of the intermetallic compounds.

A degradable structural member produced from the magnesium alloy of the present invention is used when performing fracking; is degradable at a rate suitable for the mining site; and increases the productivity of mining.

DETAILED DESCRIPTION OF THE INVENTION

Figure 1:
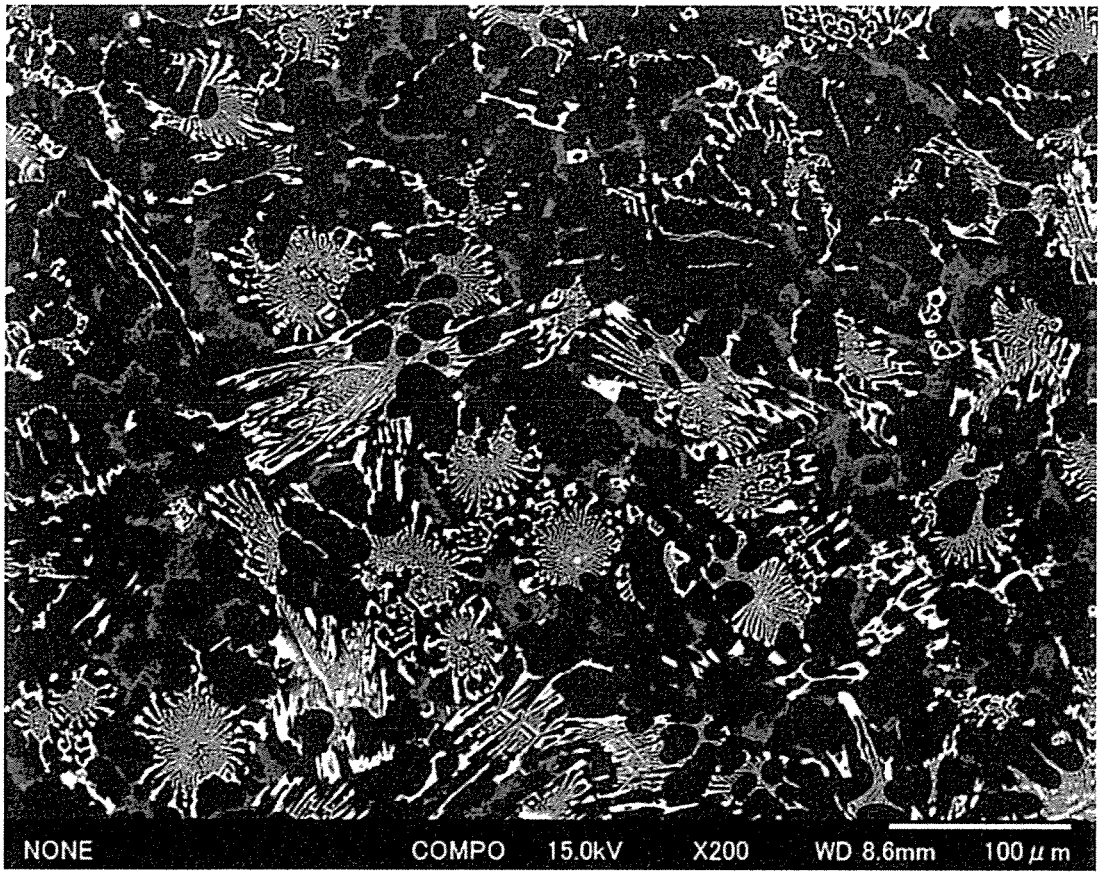
FIG. 1 is an SEM image showing a composition image of a cast member of Example 5.

The present invention is described below in detail.

The present invention is directed to a magnesium alloy which can be corroded at a high rate in a predetermined environment, a degradable structural member using the magnesium alloy, and a method for adjusting the corrosion rate of the degradable structural member.

The Al content of the magnesium alloy according to the present invention needs to be not less than 7.0% by mass. If the Al content is too low, the flowability of molten metal during casting will deteriorate, and also the amount of Cu—Al—Mg-based intermetallic compounds will be insufficient, whereas, if the Al content is not less than 7.0% by mass, it is possible to ensure sufficient flowability of molten metal, and a sufficient amount of the Cu—Al—Mg-based intermetallic compounds. On the other hand, the Al content needs to be not more than 13.0% by mass. This is because, if the Al content is too high, an excessive amount of Cu—Al—Mg-based intermetallic compounds will be produced, and, if the Al content is higher than 13.0% by mass, the Cu—Al—Mg-based intermetallic compounds will hinder the advancement of Mg corrosion, thus causing a sharp decrease in corrosion rate.

The magnesium alloy of the present invention may contain Mn. Mn is effective in removing some elements contained as impurities. Therefore, the addition of even a small amount of Mn will reduce the influence of other elements on the corrosion rate of the alloy which needs to be adjusted, and thus to more accurately adjust the corrosion rate of the degradable structural member produced from the magnesium alloy. However, the Mn content needs to be less than 0.10% by mass. This is because, if the Mn content is high, Mn will be contained in the Cu—Al—Mg-based intermetallic compounds, and thus the Cu—Al—Mg-based intermetallic compounds are likely to become coarse. If the Cu—Al—Mg-based intermetallic compounds become coarse, the corrosion rate will decrease.

The Cu content of the magnesium alloy according to the present invention needs to be not less than 4.5% by mass. By adding Cu, Cu—Al—Mg-based intermetallic compounds having a positive electric potential are formed in the structural member obtained by casting the magnesium alloy of the present invention. The difference in electric potential between α-Mg and Cu—Al—Mg-based intermetallic compounds accelerates shrinkage of α-Mg due to microcell corrosion, and thus improves the corrosion rate. If an ordinary Mg alloy contains Al, the Al tends to reduce the corrosion rate. However, if the Cu content is not less than 4.5% by mass, even if the Al content is within the above range, the corrosion rate of the above degradable structural member will be a practically acceptable level. The Cu content is especially preferably not less than 7.0% by mass. If the Cu content is not less than 7.0% by mass, the amount of the Cu—Al—Mg-based intermetallic compounds increases, and also, it is considered that, when strain is applied to the degradable structural member obtained by casting this magnesium alloy, the Cu—Al—Mg-based intermetallic compounds are easily crushed into small pieces, so that the Cu—Al—Mg-based intermetallic compound phase becomes fine, thereby improving the corrosion rate. On the other hand, the Cu content needs to be not more than 13.0% by mass. If the Cu content is higher than 13.0% by mass, coarse block-shaped Cu—Al—Mg-based intermetallic compounds are formed during casting, thereby hindering the advancement of Mg corrosion. This reduces the effect of improving the corrosion rate due to the microcell corrosion caused by adding Cu.

The magnesium alloy of the present invention may contain, as unavoidable impurities, elements other than the above elements. The unavoidable impurities are elements unavoidably and unintentionally contained due to a problem in manufacturing or a problem of the raw material. Such impurities include Ag, Fe, Ca, Cd, Ga, In, Li, Mm (misch metal), Ni, Pb, Se, Si, Ti, Y, Zn and Zr. The contents of the impurities need to be within ranges in which the impurities do not ruin the properties of the magnesium alloy according to the present invention, and the content of each of the impurities is preferably less than 0.2% by mass, more preferably less than 0.1% by mass. Of these impurities, the content of each of especially Si, Li, In and Ca is preferably less than 0.1% by mass, more preferably less than 0.05% by mass. Also, the content of any of the impurities is preferably as low as possible, because this eliminates uncertainties that need to be taken into consideration when adjusting the degradation rate by. Cu as described above. It is particularly preferable that these contents are all below the detection limit.

The degradable structural member produced from the magnesium alloy of the present invention is, besides Al, Mn, Cu and unavoidable impurities, composed of Mg, and is processed to have finely dispersed intermetallic compounds.

The magnesium alloy according to the present invention can be prepared with a general method, using a raw material which contains the above elements such that the composition ratio will be within the above ranges (in mass percent), and such that the degradation rate will be a desirable rate. The above mass percentage values are not based on the mass of the raw material, but based on the mass of the prepared alloy or a degradable structural member produced by, e.g., casting or sintering the alloy.

It is possible to obtain a suitable degradable structural member according to the present invention by casting. The term "suitable" means that the corrosion rate and the tensile strength of the degradable structural member are adjusted to values suitable for the fracking site such that the structural member has properties that improve the productivity of mining.

Also, by applying a large strain to the degradable structural member obtained by casting, it is possible to finely disperse the Cu—Al—Mg-based intermetallic compounds, and thus improve the corrosion rate and the mechanical properties. Specifically, by applying strain, it is possible to reduce the average equivalent diameter d of the Cu—Al—Mg-based intermetallic compounds. Basically, the average equivalent diameter d is preferably as small as possible. Specifically, the average equivalent diameter d is preferably 10 μm or less, more preferably 5 μm or less, even more preferably 2 μm or less. On the other hand, it is practically difficult to reduce the average equivalent diameter d to less than 0.1 μm. 0.1 μm or more would be a realistic value, and 0.5 μm or more would be a more practicable value.

Methods for applying strain to a member obtained by casting include, e.g., drawing, extruding, rolling, pressing, and performing ECAP (Equal Channel Angular Pressing) to, the member. An appropriate method can be selected from among these methods according to the shape of the member that is to be obtained. When a magnesium alloy is formed by casting, the average crystal grain size D of the crystal sizes of α-Mg will be 100 to 200 μm, but it is preferable to reduce the crystal sizes to about 5 μm or more and 25 μm or less by the above extruding, rolling, drawing, etc.

The corrosion rate of the degradable structural member according to the present invention is adjustable by the Cu content "CU" and the Al content "AL". It has been discovered that the corrosion rate is adjustable according to the square of "CU" and the square of "1/AL". Also, the corrosion rate is adjustable by the average equivalent diameter d of the Cu—Al—Mg-based intermetallic compounds. The relationship in the following Formula (1) is established relative to these values and constant p. Pc in Formula (1) is a parameter that becomes a linear function of the following Formula (2) relative to a corrosion rate $W_{Est}$ ($a_1$ and $b_1$ are constants that vary per environment). Therefore, by adjusting the average equivalent diameter d, too, the corrosion rate $W_{Est}$ is adjustable.

$$Pc=(CU^2/AL^2)/(1+p\times d) \quad \text{<Formula (1)>}$$

$$W_{Est}=a_1\times Pc+b_1 \quad \text{<Formula (2)>}$$

Also, it has been discovered that the tensile strength of the degradable structural member according to the present invention is adjustable according to the first power of "AL" and the first power of "CU"; and that the tensile strength is also adjustable according to the square root of the above average equivalent diameter d. The relationship in the following Formula (3) is established relative to these values and constants u and v. Ps in Formula (3) is a parameter that becomes a linear function of the following Formula (4) relative to an estimated tensile strength $\sigma_{T,\,Est}$ ($a_2$ and $b_2$ are constants that vary per environment). Therefore, by adjusting the average equivalent diameter d, the tensile strength $\sigma_{T,\,Est}$ is adjustable.

$$Ps=u\times AL-CU+v/(d)^{1/2} \quad \text{<Formula (3)>}$$

$$\sigma_{T,Est}=a_2\times Ps+b_2 \quad \text{<Formula (4)>}$$

By using the above Formulas (1) to (4), a degradable structural member made of a magnesium alloy, and having a predetermined tensile strength and a predetermined corrosion rate can be prepared based on the Al content, Cu content and average equivalent diameter d. Also, these formulas show that the corrosion rate and the tensile strength of the magnesium alloy according to the present invention are not necessarily contrary to each other. Therefore, by adjusting the Al content, the Cu content, and the average equivalent diameter d of the Cu—Al—Mg-based intermetallic compounds based on the relationships between these parameters Pc and Ps and the corrosion rate and the tensile strength, within the above-described content ranges of Al, Cu and Mn, it is possible to individually control the corrosion rate and tensile strength of a magnesium alloy having high degradability.

Products to which the degradable structural member composed of the magnesium alloy according to the present invention is applied include, e.g., drilling tools used for the drilling of oil wells, natural gas wells, etc. Since such drilling tools are introduced deep into the ground, and exposed to high water pressure, they need to have strength enough to withstand a high-pressure environment. On the other hand, when the drilling tools become unnecessary, they corrode and degrade at an appropriate time by being exposed to the aqueous solution introduced during drilling, and thus can be easily removed without the need to taking them out from deep in the ground.

Example(s)

Magnesium alloys according to the present invention were actually prepared, and members were produced therefrom. The steps and test method are described below.

<Sample Production>

Magnesium alloys were each prepared such that the amounts of the elements other than Mg contained in the magnesium alloy would be the respective mass percentages shown in Table 1. By heating the prepared magnesium alloys to 700° C., and casting them in an iron mold, cast members were produced. Next, by applying an external force to the cast members now heated to about 370° C., 560% strain was applied thereto, thereby producing processed members. By this processing, the cross-sectional area of each processed member was reduced to 1/32 of the cast member.

TABLE1

| | Chemical composition (mass %) | | | | Average equivalent diameter d (μm) of Cu—Al—Mg intermetallic compounds | Average crystal grain size D (μm) of α-Mg of |
|---|---|---|---|---|---|---|
| | Al | Cu | Mn | Mg | of processed member | processed member |
| Example 1 | 7.04 | 11.6 | 0.023 | Balance | 0.741 | 11 |
| Example 2 | 7.38 | 4.65 | 0.033 | Balance | 1.07 | 18 |
| Example 3 | 7.72 | 6.01 | 0.032 | Balance | 1.06 | 17 |
| Example 4 | 8.85 | 10.5 | 0.018 | Balance | 3.38 | 14 |
| Example 5 | 9 | 10.6 | 0.017 | Balance | 1.11 | 14 |
| Example 6 | 9.97 | 10.1 | 0.053 | Balance | 0.526 | 11 |
| Example 7 | 10.2 | 7.87 | 0.018 | Balance | 3.82 | 17 |
| Example 8 | 10.5 | 10.4 | 0.017 | Balance | 3.9 | 16 |
| Example 9 | 10.6 | 12.6 | 0.016 | Balance | 3.36 | 16 |
| Example 10 | 11.3 | 10.3 | 0.016 | Balance | 3.71 | 17 |
| Example 11 | 10.1 | 12.6 | 0.032 | Balance | 1.11 | 14 |
| Example 12 | 12.2 | 11.8 | 0.031 | Balance | 1.18 | 21 |
| Example 13 | 9.81 | 12.5 | 0.077 | Balance | 1.17 | 20 |
| Example 14 | 8.44 | 12.9 | 0.007 | Balance | 1.03 | 15 |
| Comparative Example 1 | 12.1 | 9.87 | 0.20 | Balance | 1.06 | 12 |
| Comparative Example 2 | 7.96 | 6.95 | 0.22 | Balance | 1.94 | 15 |
| Comparative Example 3 | 12.5 | 15.6 | 0.015 | Balance | 1.12 | 12 |
| Comparative Example 4 | 9.8 | 17 | 0.021 | Balance | 1.03 | 10 |
| Comparative Example 5 | 13.1 | 11.3 | 0.055 | Balance | 0.777 | 10 |
| Comparative Example 6 | 10.1 | 12.3 | 0.11 | Balance | 1.01 | 10 |
| Comparative Example 7 | 11.7 | 13.6 | 0.015 | Balance | 1.07 | 17 |
| Comparative Example 10 | 9.94 | 12.3 | 0.10 | Balance | 1.08 | 19 |

Figure 2:
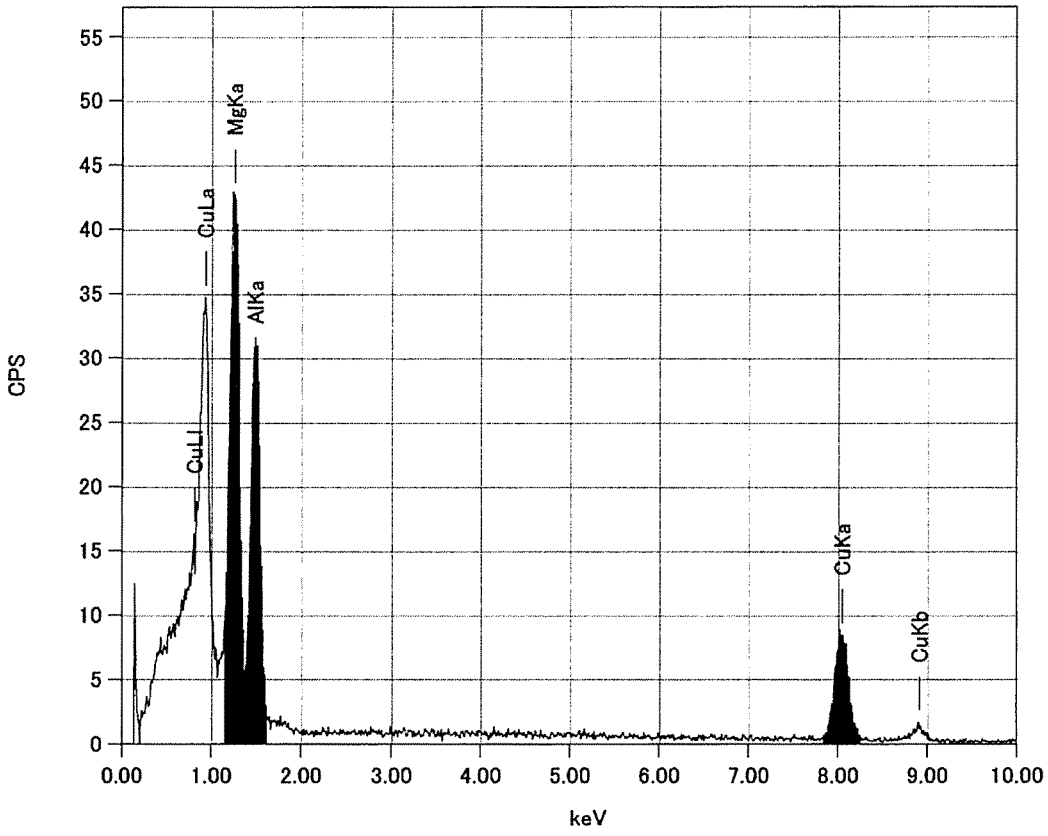
FIG. 2 shows an EDS analysis result of intermetallic compounds observed in bright fields of FIG. 1.
Figure 3:
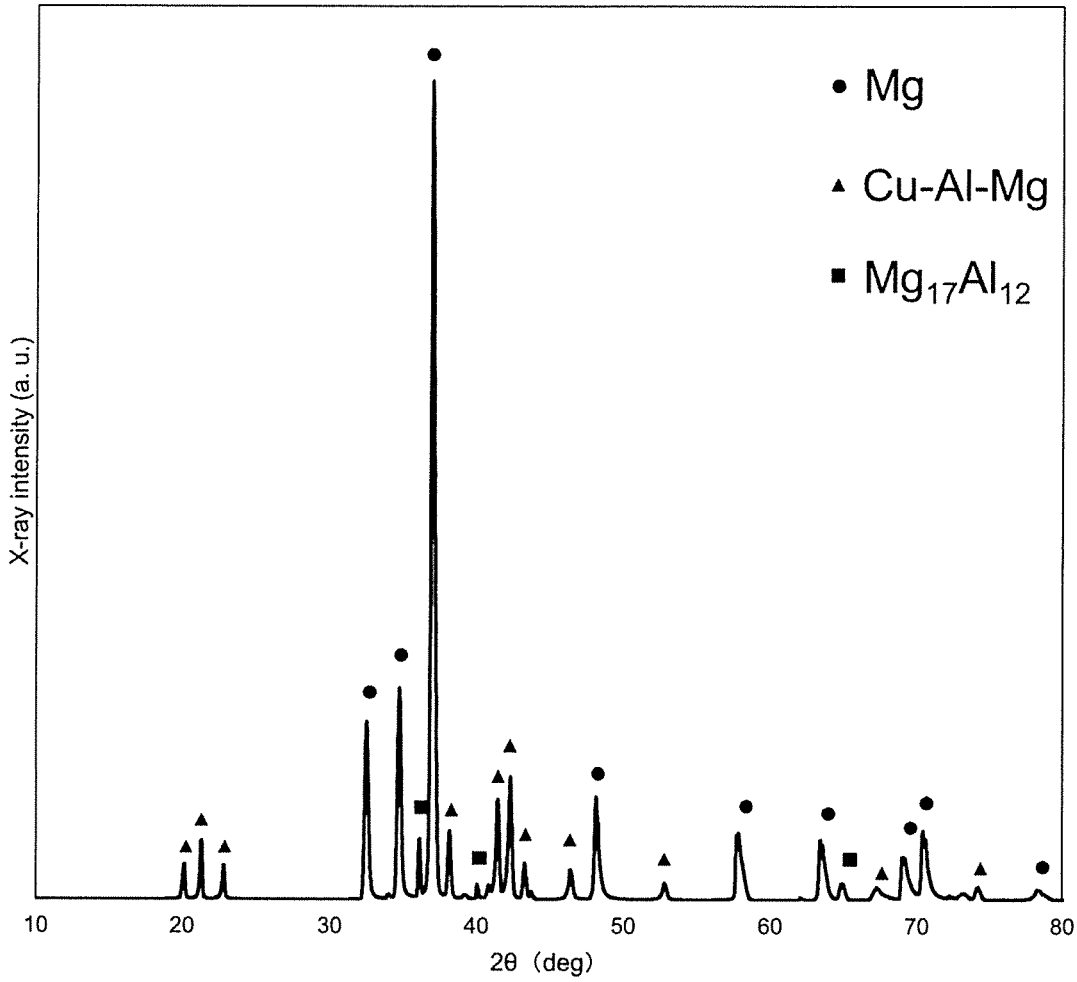
FIG. 3 shows an XRD spectrum of the cast member of Example 5.
Figure 4:
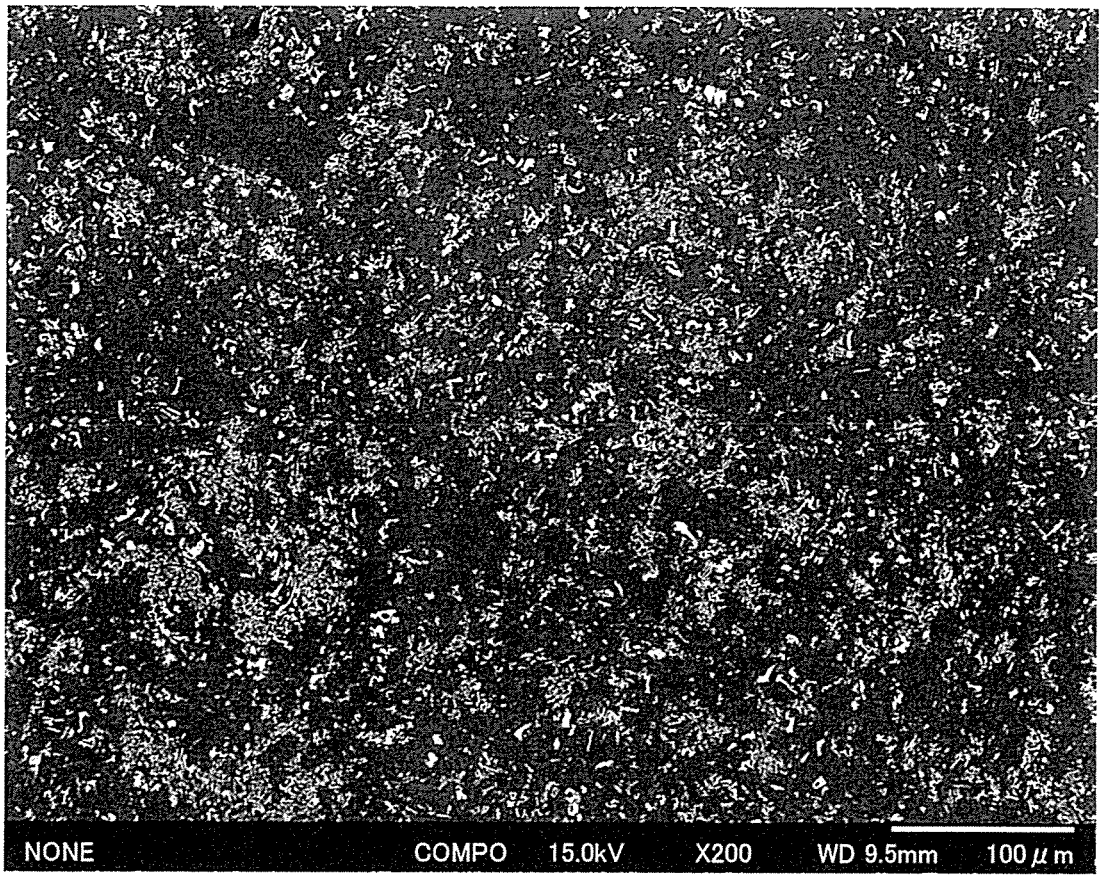
FIG. 4 is an SEM image showing a composition image of a processed member of Example 5.

FIG. 1 shows a composition image of the cast member of Example 5 obtained by SEM observation. FIG. 2 shows an EDS analysis result of the intermetallic compounds observed as bright fields of FIG. 1. FIG. 3 shows an XRD result of the cast member of Example 5. These results show that the cast member is composed of α-Mg, Cu—Al—Mg-based intermetallic compounds, and $Mg_{17}Al_{12}$. FIG. 4 shows a composition image of the processed member of Example 5 obtained by SEM observation. This image shows that the Cu—Al—Mg-based intermetallic compounds are separated, crushed, and finely dispersed by processing. These facts, namely (i) the fact that "the cast member contains α-Mg, Cu—Al—Mg-based intermetallic compounds, and $Mg_{17}Al_{12}$", and (ii) the fact that "the Cu—Al—Mg-based intermetallic compounds are crushed by processing", are applicable to the other Examples and the Comparative Examples, too.

The "average equivalent diameter d of Cu—Al—Mg-based intermetallic compounds" in Table 1 was calculated as follows: In a composition image of each processed member obtained by SEM observation, by identifying bright-fields by image analysis, the equivalent diameters of the bright fields were measured, and the arithmetic mean thereof was calculated as the average equivalent diameter d (μm). The "average crystal grain size D of α-Mg" in Table 1 was measured as follows: In an image of each processed member obtained by optical microscope observation after grain boundary corrosion, by identifying the grain boundaries by image analysis, the equivalent diameters of the grain boundaries were measured, and the arithmetic mean thereof was calculated as the average crystal grain size D. The arithmetic mean calculated as each of the average equivalent diameter d and the average crystal grain size D is the total sum of the measured grain sizes divided by the number of the measured grains. In the Examples and the Comparative Examples, the average equivalent diameters of the Cu—Al—Mg-based intermetallic compounds are different fairly significantly, but the average crystal grain sizes are not so significantly different.

Figure 5:
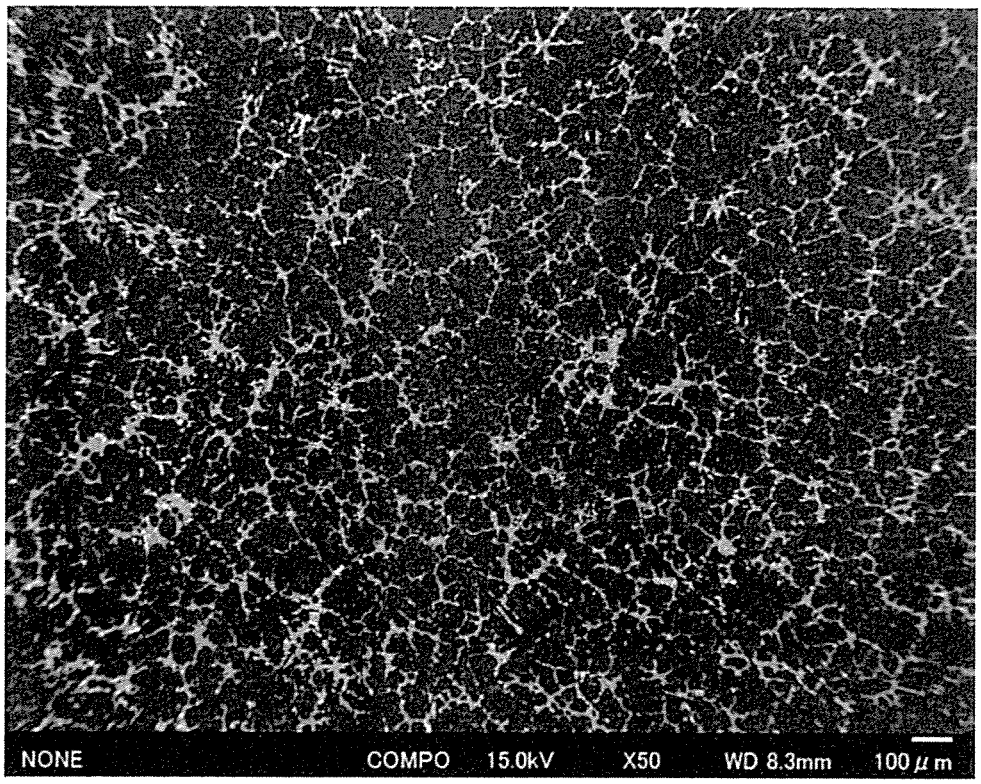
FIG. 5 is an SEM image showing a composition image of a cast member of Example 3.
Figure 5:
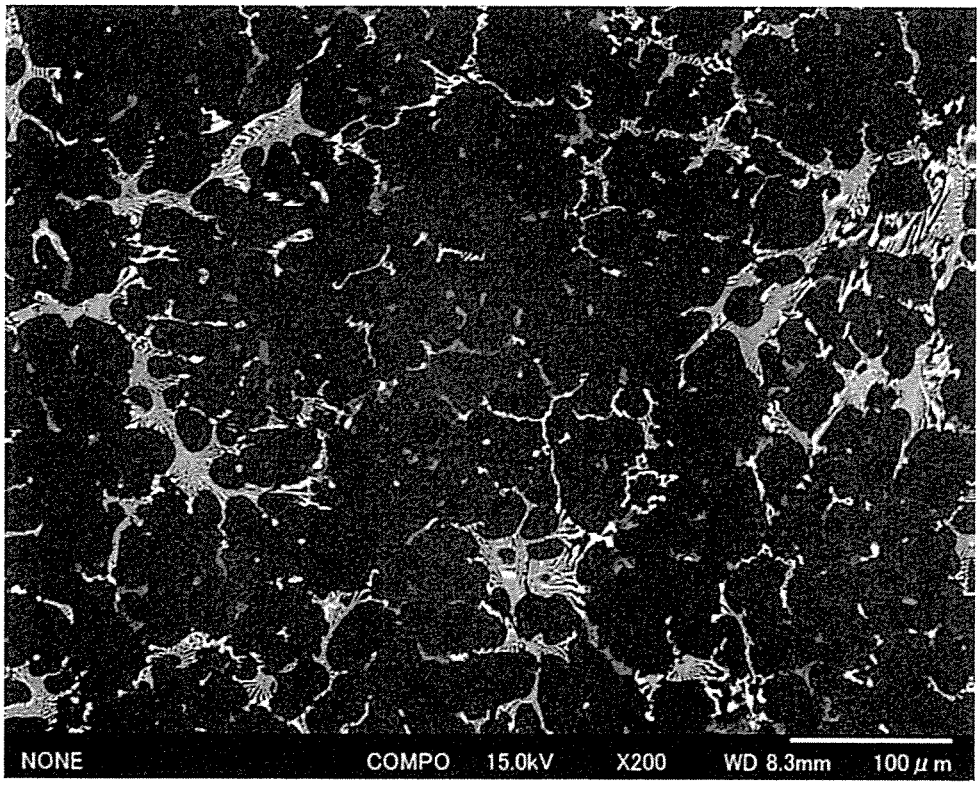
Figure 6:
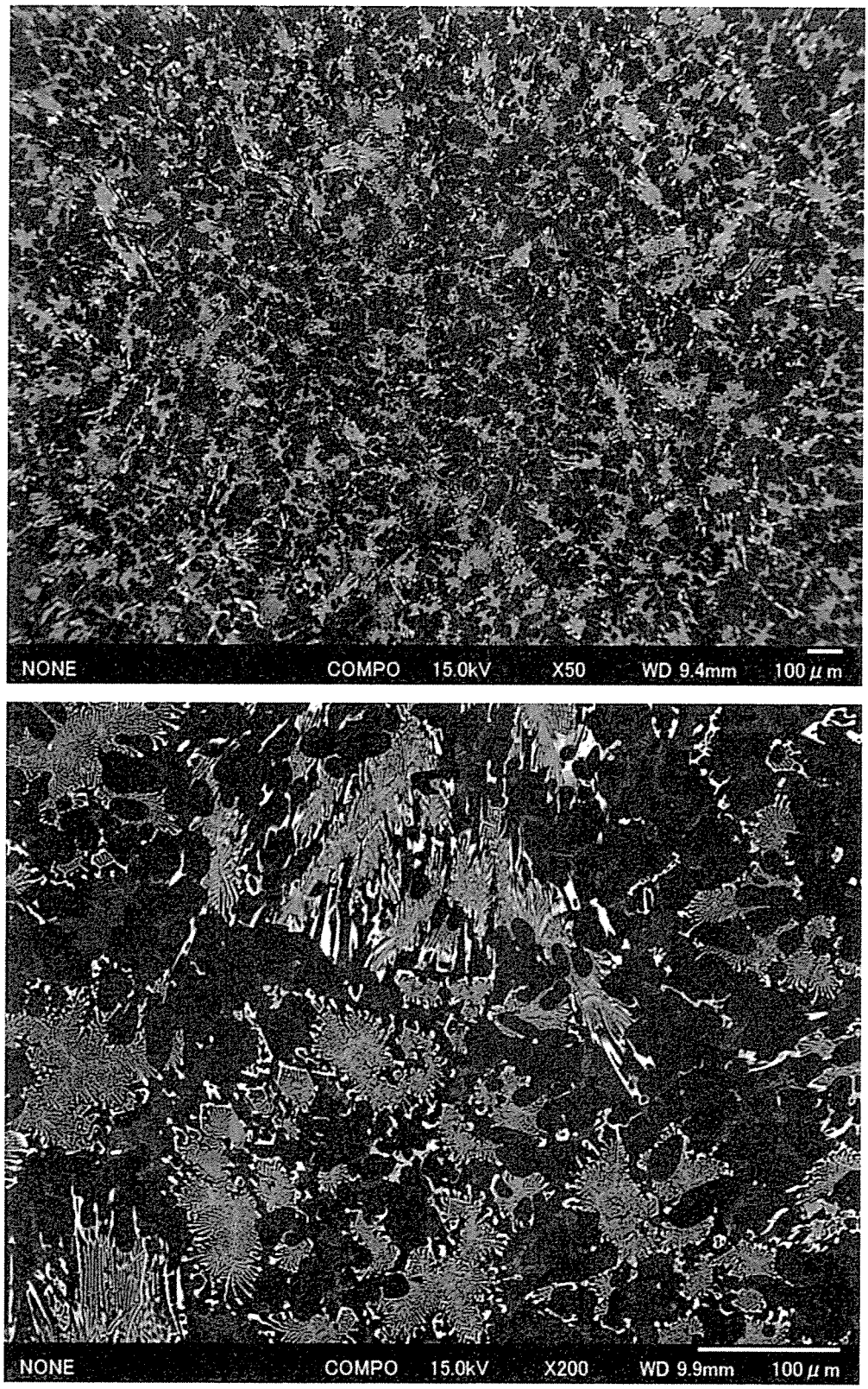
FIG. 6 is an SEM image showing a composition image of a cast member of Example 1.

FIGS. 5 and 6 show respective composition images of the cast members of Examples 3 and 1 obtained by SEM observation. In Example 3, in which the Cu content of the Cu—Al—Mg-based intermetallic compounds is low, the intermetallic compounds are mesh-shaped as a whole, whereas, in Example 1, in which the Cu content is high, the intermetallic compounds are dispersed. Specifically, it is considered that, if the Cu content is less than 7.0% by mass, since the Cu—Al—Mg-based intermetallic compounds are mesh-shaped, stress is distributed uniformly when strain is applied, so that the Cu—Al—Mg-based intermetallic compounds cannot be easily crushed. On the other hand, it is considered that, if the Cu content is not less than 7.0% by mass, since the Cu—Al—Mg-based intermetallic compounds are dispersed, stress concentration is likely to occur when strain is applied thereto, so that, even with a relatively small strain, the Cu—Al—Mg-based intermetallic compounds can be crushed into fine pieces, and dispersed more uniformly.

Figure 7:
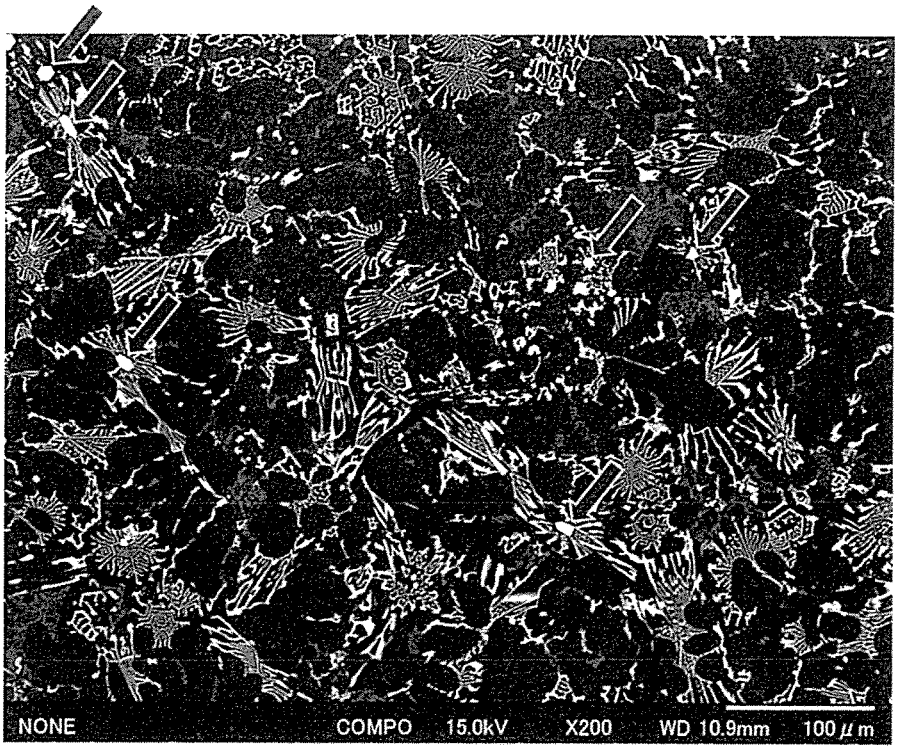
FIG. 7 is an SEM image showing a composition image of a cast member of Comparative Example 1.
Figure 8:
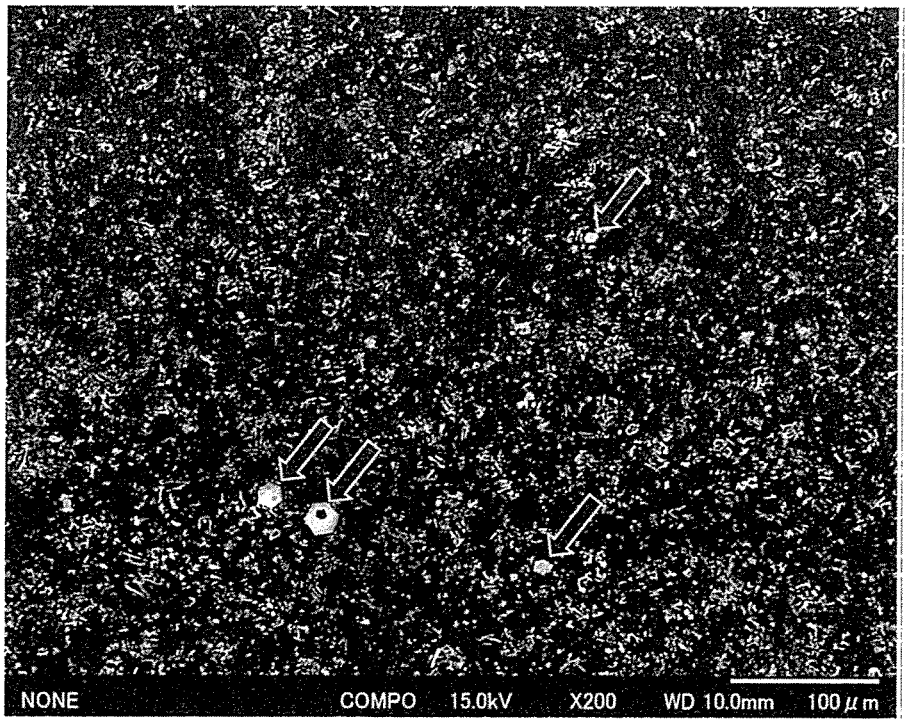
FIG. 8 is an SEM image showing a composition image of a processed member of Comparative Example 1.
Figure 9:
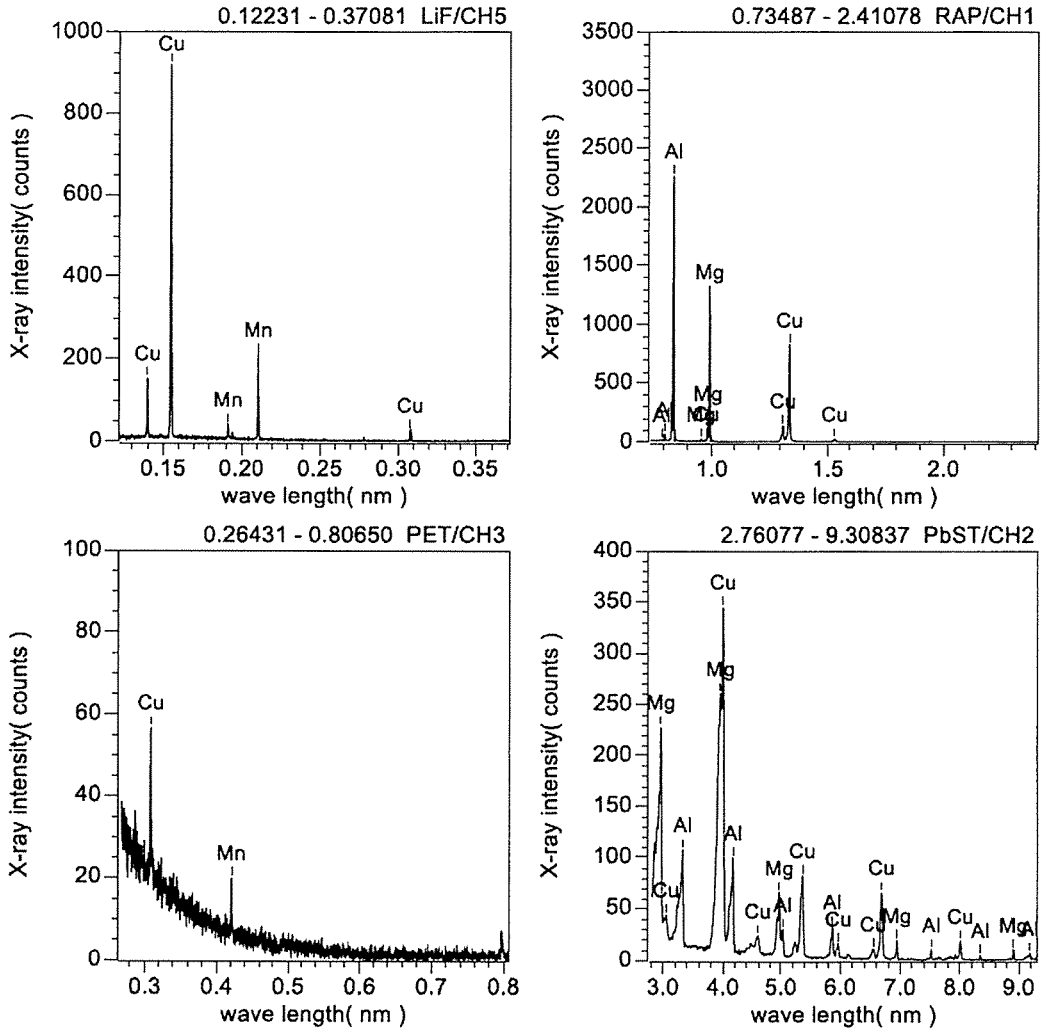
FIG. 9 shows EPMA analysis results of hexagonal intermetallic compounds of Comparative Example 1.

FIGS. 7 and 8 show respective composition images of the cast member and the processed member of Comparative Example 1 obtained by SEM observation. It is apparent from these figures that, because the hexagonal intermetallic compounds observed in these figures are low in aspect ratio, they are not crushed even when strain is applied (see the arrows in FIGS. 7 and 8). FIG. 9 shows EPMA analysis results of the hexagonal intermetallic compounds. These analysis results show that the hexagonal intermetallic compounds are composed of Mg, Al, Cu and Mn. This is true for Comparative Example 2, too. Such intermetallic compounds are slightly observed in Comparative Examples 6 and 10, too, but, are not observed in the other Examples and Comparative Examples. This indicates that the addition of Mn causes the formation of coarse intermetallic compounds.

Figure 10:
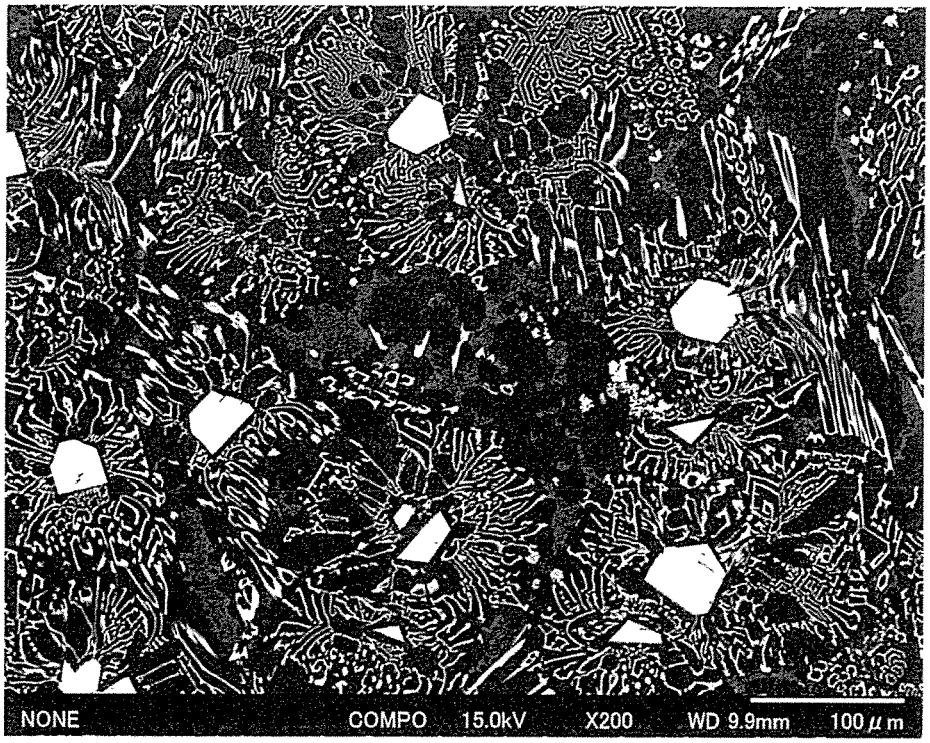
FIG. 10 is an SEM image showing a composition image of a cast member of Comparative Example 3.
Figure 11:
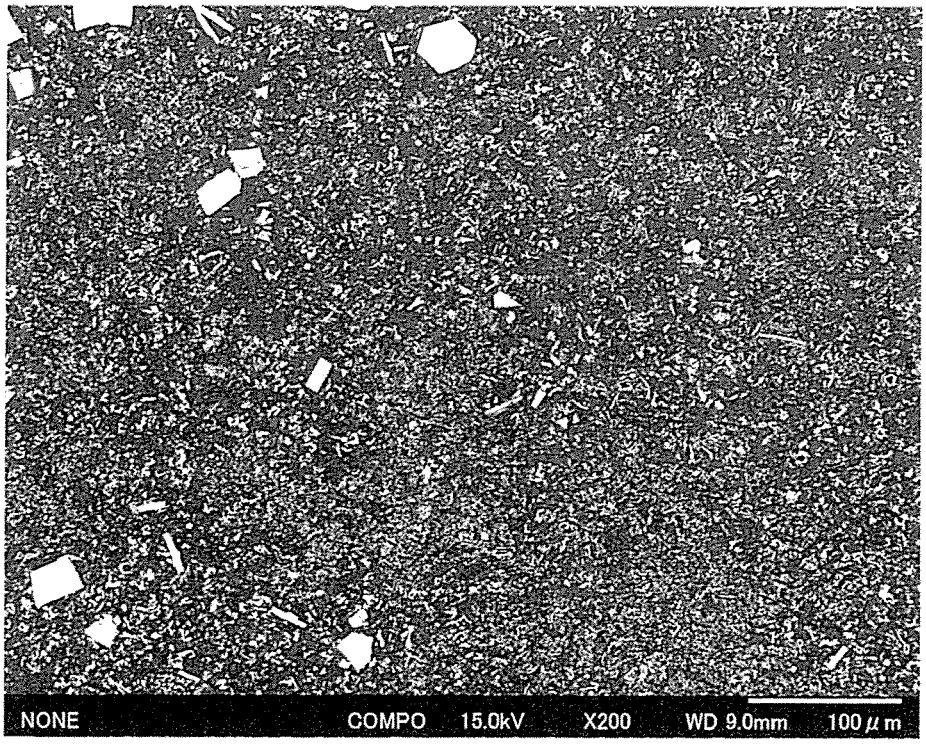
FIG. 11 is an SEM image showing a composition image of a processed member of Comparative Example 3.

FIGS. 10 and 11 show respective composition images, obtained by SEM observation, of the cast member and the processed member of Comparative Example 3, in which the Cu content is more than 13.0% by mass. In these images, coarse block-shaped intermetallic compounds are observed, and because these coarse intermetallic compounds are low in aspect ratio, they are not crushed even when strain is applied. Such intermetallic compounds are observed in Comparative Example 4, too, and are slightly observed in Comparative Example 7, too. This indicates that, if the Cu content is more than 13.0% by mass, Cu is used mainly to form coarse block-shaped intermetallic compounds which are low in aspect ratio.

<Castability Test>

Each raw material was prepared, heated to 700° C., and poured, with the composition shown in Table 2, into an iron mold capable of forming a rectangular cast member having a thickness of 5 mm, a width of 35 mm and a length of 235 mm. The iron mold has one longitudinal end thereof open, and includes, on the other longitudinal end, air holes. The raw material was poured into the mold through the open longitudinal end. The obtained cast members for the test had the lengths shown in Table 2, respectively. Table 2 shows that, in order to obtain sufficient castability, the Al content is preferably not less than 7.0% by mass.

TABLE 2

| | Chemical composition (mass %) | | | | Length of cast |
|---|---|---|---|---|---|
| | Al | Cu | Mn | Mg | member (mm) |
| Comparative Example 8 | 2.87 | 11.4 | 0.024 | Balance | 211 |
| Comparative Example 9 | 4.82 | 11.6 | 0.023 | Balance | 225 |
| Example 1 | 7.04 | 11.6 | 0.023 | balance | 235 |

<Corrosion Rate and Mechanical Property Tests>

The processed members of the Examples and Comparative Examples were immersed in a 2% KCl aqueous solution (93° C.), and, by measuring the masses (mg) and the surface areas of each test sample before and after the test, the corrosion rate per day (mg/cm$^2$/day: mcd) was calculated. Also, using these processed members, a tensile test was conducted based on JISZ2241 (ISO 6892). The results of these tests are shown in Table 3. The surface of the test sample of Comparative Example 5 turned white after the corrosion test, whereas, the surfaces of the test samples of the other Examples and Comparative Examples turned gray after the corrosion test. Also, the corrosion rate in Comparative Example 5 was extremely low compared to the other Examples. This is considered to be because the Al content was too high, and thus stable corrosion products were formed and adhered to the test sample. The Al content is therefore preferably not more than 13.0% by mass.

As shown in Table 1, in Examples 11 and 13, and Comparative Example 10, the Al contents, the Cu contents, and the average equivalent diameters d of the intermetallic compounds are substantially the same, and the Mn contents are different from each other, specifically, 0.032% by mass, 0.077% by mass, and 0.10% by mass, respectively. As shown in Table 3, the corrosion rates of Examples 11 and 13 are substantially the same, specifically, 2616 mdc and 2797 mcd, respectively, but, the corrosion rate of Comparative Example 10 is low, specifically, 2259 mcd. This shows that, if the Mn content is not less than 0.1% by mass, the corrosion rate decreases.

Figure 12:
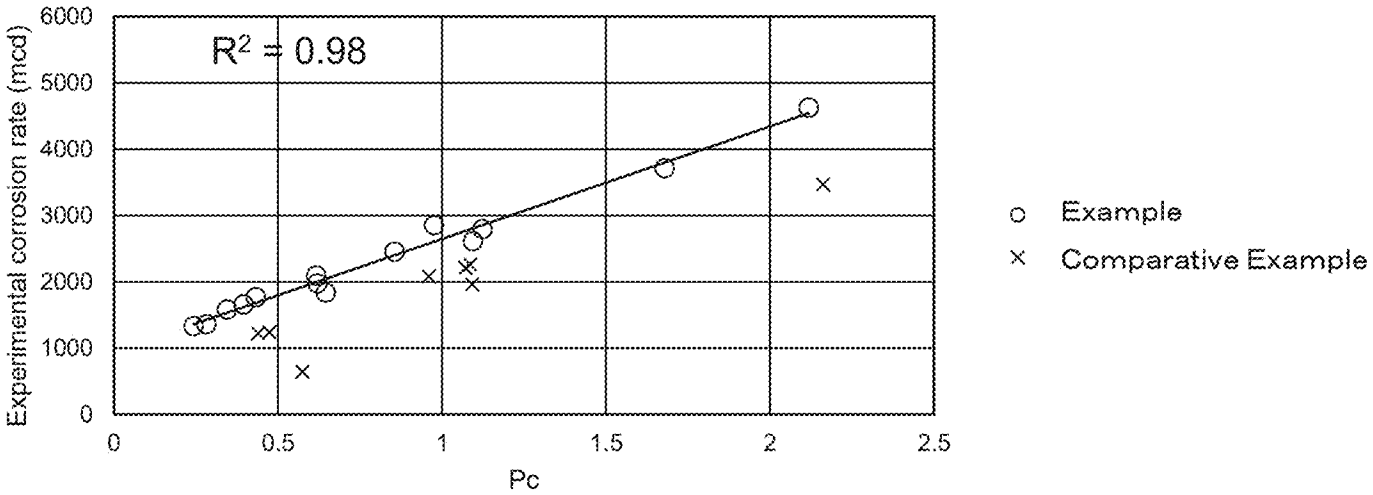
FIG. 12 is a graph showing a linear relationship of parameters Pc of corrosion rates in Examples and Comparative Examples.

As shown in FIG. 12, the corrosion rates of the processed members of Examples 1 to 10 can be arranged in a linear relationship by the parameter Pc of the above Formula (1), which is expressed by the Al content "AL" (mass %), the Cu content "CU" (mass %) and the average equivalent diameter d (μm) of the Cu—Al—Mg-based intermetallic compounds.

$$Pc=(CU^2/AL^2)/(1+p\times d) \quad \text{<Formula (1)>}$$

p in Formula (1) is a constant, and is 0.38 (p=0.38) in the Examples. The corrosion rate can be estimated based on the above Formulas (1) and (2), as shown in the following Formula (5):

$$\text{Estimated corrosion rate: } W_{Est}=1697\times Pc+949 \quad \text{<Formula (5)>}$$

Based on the estimated corrosion rate, it is possible to design a magnesium alloy having a predetermined corrosion rate.

Formula 1 shows that the higher the Cu content, the higher the corrosion rate, whereas, the higher the Al content, the lower the corrosion rate. In order to ensure sufficient flowability of the molten metal, the Al content is preferably not less than 7.0% by mass. In Example 2, in which the Al content is 7.38% by mass and the Cu content is 4.65% by mass, the corrosion rate is 1362 mcd. Because this corrosion rate is within the range of general degradation rates of degradable frac plugs, which is 1000 to 1500. In order to achieve a corrosion rate that is practical as a magnesium alloy having high degradability, the Cu content is preferably not less than 4.5% by mass. FIG. 12 includes the data of the Comparative Examples, too, and shows that the corrosion rates in the Comparative Examples are at a lower level than the linear relationship obtained from the above Examples, i.e., these corrosion rates are low due to the above-described metallographic features.

TABLE 3

| | | Tensile test | | |
|---|---|---|---|---|
| | Corrosion rate mcd | Tensile strength MPa | 0.2% proof stress MPa | Elongation % |
| Example 1 | 4626 | 330 | 237 | 4.9 |
| Example 2 | 1362 | 329 | 221 | 12.5 |
| Example 3 | 1769 | 334 | 226 | 11.1 |
| Example 4 | 2095 | 288 | 197 | 9.5 |
| Example 5 | 2854 | 326 | 234 | 7.1 |
| Example 6 | 2455 | 370 | 265 | 9.3 |
| Example 7 | 1333 | 291 | 209 | 7 |
| Example 8 | 1663 | 293 | 210 | 9.3 |
| Example 9 | 1975 | 280 | 230 | 1.7 |
| Example 10 | 1585 | 299 | 241 | 3.8 |
| Example 11 | 2616 | 335 | 229 | 8.8 |
| Example 12 | 1839 | 349 | 255 | 5.6 |
| Example 13 | 2797 | 334 | 232 | 9.2 |
| Example 14 | 3714 | 309 | 227 | 6.1 |
| Comparative Example 1 | 1242 | — | — | — |
| Comparative Example 2 | 1225 | — | — | — |
| Comparative Example 3 | 1961 | — | — | — |
| Comparative Example 4 | 3470 | — | — | — |
| Comparative Example 5 | 643 | — | — | — |
| Comparative Example 6 | 2215 | — | — | — |
| Comparative Example 7 | 2084 | — | — | — |
| Comparative Example 10 | 2259 | — | — | — |

Table 4 shows the respective corrosion rates in Table 3 divided by the corresponding $W_{Est}$ values of the above Formula (5). These values of Examples 1 to 14 are 0.90 to 1.10, whereas, these values of Comparative Examples 1 to 7 are all not more than 0.81. That is, Table 4 clearly shows that the corrosion rates of the Comparative Examples are all lower than the corresponding estimated corrosion rates obtained from Formula (5).

TABLE 4

| | | | |
|---|---|---|---|
| Example 1 | 1.02 | Comparative Example 1 | 0.71 |
| Example 2 | 0.95 | Comparative Example 2 | 0.72 |
| Example 3 | 1.05 | Comparative Example 3 | 0.7 |
| Example 4 | 1.05 | Comparative Example 4 | 0.75 |
| Example 5 | 1.1 | Comparative Example 5 | 0.33 |
| Example 6 | 1.02 | Comparative Example 6 | 0.8 |
| Example 7 | 0.98 | Comparative Example 7 | 0.81 |
| Example 8 | 1.03 | Comparative Example 10 | 0.81 |
| Example 9 | 0.99 | | |
| Example 10 | 1.03 | | |
| Example 11 | 0.93 | | |
| Example 12 | 0.9 | | |
| Example 13 | 0.98 | | |
| Example 14 | 0.98 | | |

Figure 13:
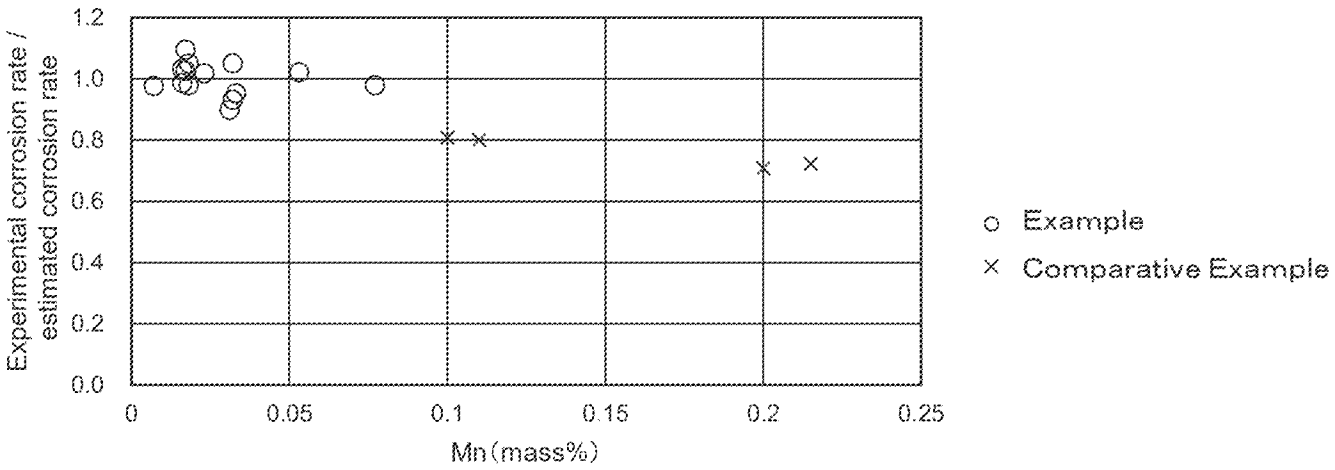
FIG. 13 is a graph plotting the relationship between the ratio of an actual corrosion rate to an estimated corrosion rate, and the Mn content in each of Examples and Comparative Examples.

FIG. 13 is a graph in which, for the processed members of Examples 1 to 14 and Comparative Examples 1, 2, 6 and 10, the horizontal axis shows the Mn contents, and the vertical axis shows the values in Table 4. This graph shows that, in the Comparative Examples where the Mn contents are not less than 0.10% by mass, the corrosion rates are lower than the estimated corrosion rates obtained from the above Formula (5).

Figure 14:
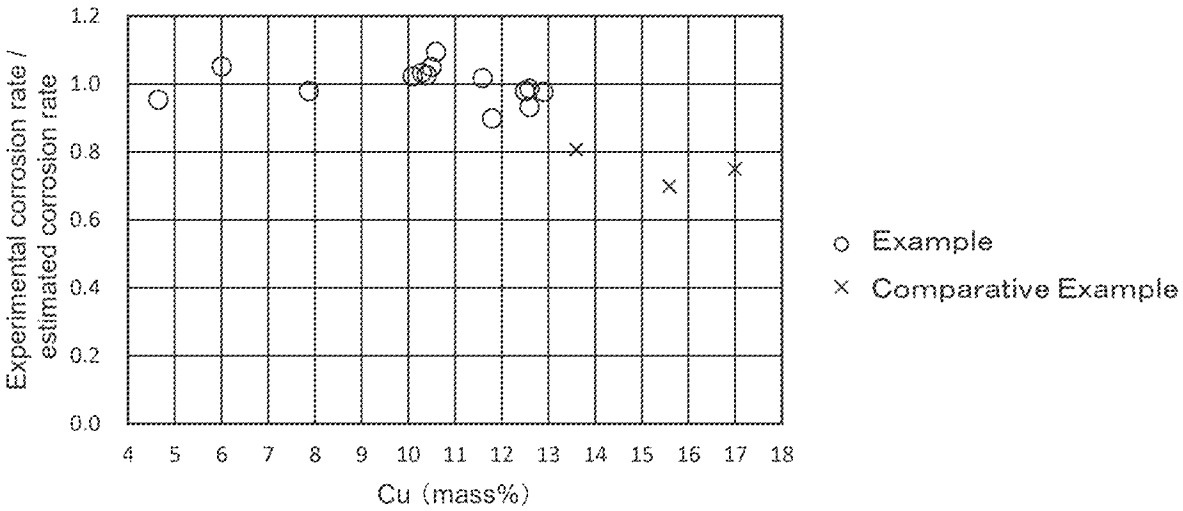
FIG. 14 is a graph plotting the relationship between the ratio of the actual corrosion rate to the estimated corrosion rate, and the Cn content in each of Examples and Comparative Examples.

FIG. 14 is a graph in which, for the processed members of Examples 1 to 14 and Comparative Examples 3, 4 and 7, the horizontal axis shows the Cu contents, and the vertical axis shows the values in Table 4. This graph shows that, in the Comparative Examples where the Cu contents are more than 13.0% by mass, the corrosion rates are lower than the estimated corrosion rates obtained from the above Formula (5).

Figure 15:
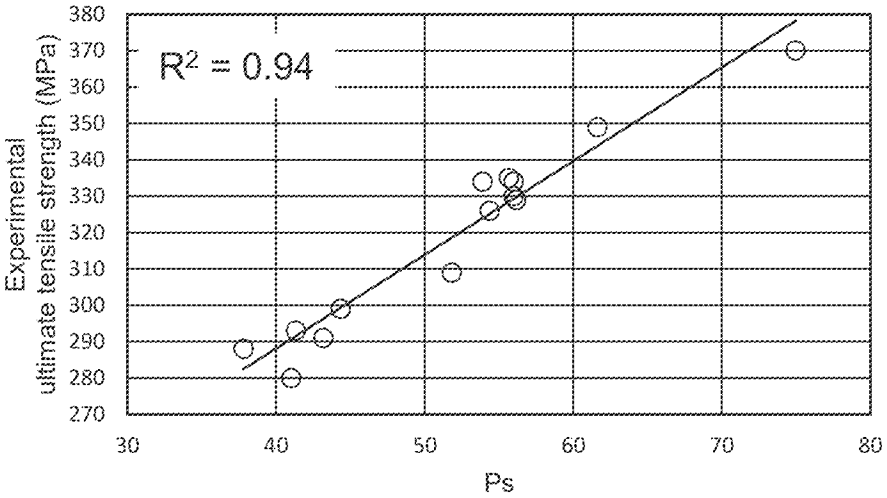
FIG. 15 is a graph showing a linear relationship of parameters Ps of tensile strengths in Examples.

As shown in FIG. 15, the tensile strengths of the processed members of Examples 1 to 14 can be arranged in a linear relationship by the parameter Ps of the above Formula (3), which is expressed by the Al content "AL" (mass %), the Cu content "CU" (mass %) and the average equivalent diameter d (μm) of the Cu—Al—Mg-based intermetallic compounds.

$$Ps=u\times AL-CU+v/(d)^{1/2} \quad \text{<Formula (3)>}$$

u and v in Formula (3) are constants, and are, respectively, 3 and 40 (u=3, v=40) in the Examples. From this linear relationship, the tensile strength can be estimated based on the above Formula (4), as shown in the following Formula (6):

$$\text{Estimated ultimate tensile strength: } \sigma_{T,Est}[\text{Mpa}] = 2.577\times Ps+185 \quad \text{<Formula (6)>}$$

Based on the estimated tensile strength, it is possible to design a magnesium alloy having a predetermined strength.

The above Formulas (1) and (3) show that the corrosion rate and the tensile strength are not necessarily contrary to each other. Therefore, in the composition range (in mass %) of $7.0\leq Al\leq 13.0$, $4.5\leq Cu\leq 13.0$, and $0\leq Mn<0.10$, by adjusting the Al content, the Cu content, and the average equivalent diameter of the Cu—Al—Mg-based intermetallic compounds based on the relationship between these parameters Pc and Ps and the corrosion rate and tensile strength, it is possible to individually control the corrosion rate and the tensile strength of a degradable structural member produced from the magnesium alloy.

For example, if the average equivalent diameter d of the intermetallic compounds can be controlled to 0.5 μm or more and less than 2 μm based on the above Formulas (1) and (5), in order to adjust the corrosion rate to 1500 mcd or more, the Cu content is preferably adjusted to a value within the range of more than 12.0% by mass and not more than 13.0% by mass. Also, if the average equivalent diameter d is restricted, due to manufacturing convenience or the shape of the member, only within the range of 2 μm or more and 4 μm or less, in order to adjust the corrosion rate to 1500 mcd or more, it is preferable to adjust the Al content within the range of not less than 10.0% by mass and not more than 11.0% by mass, and adjust the Cu content within the range of more than 10.0% by mass and not more than 13.0% by mass. If the average equivalent diameter d can be controlled to 0.8 μm or more and 1.2 μm or less, in order to design a degradable magnesium alloy or member having a tensile strength of 300 MPa or more and a target corrosion rate within the range of 2000 mcd or more and less than 5500 mcd, the chemical composition is preferably adjusted based on the above Formulas (1), (3), (5) and (6) such that the Al content is within the range of not less than 7.0% by mass and not more than 13.0% by mass, and the Cu content is within the range of not less than 12.5% by mass and not more than 13.0% by mass. Further, especially in order to design a degradable magnesium alloy or member having a tensile strength of 305 MPa or more and a target corrosion rate within the range of 2500 mcd or more and less than 5500 mcd, the chemical composition is preferably adjusted such that the Al content is within the range of not less than 7.7% by mass and not more than 10.8% by mass, and the Cu content is within the range of not less than 12.5% by mass and not more than 13.0% by mass. If the average equivalent diameter d can be, as described above, controlled to 0.8 μm or more and 1.2 μm or less, in order to design a degradable magnesium alloy or member having a tensile strength within the range of 315 MPa or more and a target corrosion rate within the range of 1500 mcd or more and less than 4000 mcd, the chemical composition is preferably adjusted such that the Al content is within the range of not less than 9.0% by mass and not more than 13.0% by mass, and the Cu content is within the range of not less than 9.0% by mass and not more than 13.0% by mass.

The invention claimed is:

1. A magnesium alloy consisting of:

not less than 7.0% by mass and not more than 13.0% by mass of Al;

not less than 4.5% by mass and not more than 13.0% by mass of Cu;

greater than 0% by mass and less than 0.10% by mass of Mn; and a balance of material being Mg and any unavoidable impurities, wherein the Al, Cu, and Mg form intermetallic compounds dispersed throughout the magnesium alloy, and wherein an average equivalent diameter of the intermetallic compounds is in a range of 0.5 μm or more to 2.0 μm or less.

2. A degradable structural member comprising the magnesium alloy according to claim 1.

3. A method of producing the degradable structural member according to claim 2, the method comprising:

casting the magnesium alloy;

after casting the magnesium alloy, breaking the intermetallic compounds of Cu—Al—Mg into pieces and dispersing the broken intermetallic compounds throughout the magnesium alloy.

4. A method of adjusting at least one of a degradation rate and mechanical properties of the magnesium alloy according to claim 1, the method comprising adjusting sizes and distribution of the intermetallic compounds.

5. A method of adjusting at least one of a degradation rate and mechanical properties of the degradable structural member according to claim 2, the method comprising adjusting sizes and distribution of the intermetallic compounds.

6. The magnesium alloy according to claim 1, wherein an amount of Cu is not less than 7.0% by mass and not more than 13.0% % by mass.

7. A magnesium alloy consisting of:

not less than 7.0% by mass and not more than 13.0% by mass of Al;

not less than 7.0% by mass and not more than 13.0% by mass of Cu;

greater than 0% by mass and less than 0.10% by mass of Mn; and a balance of material being Mg and any unavoidable impurities, wherein the Al, Cu, and Mg form intermetallic compounds dispersed throughout the magnesium alloy, and wherein an average equivalent diameter of the intermetallic compounds is 10 μm or less.

* * * * *